US011280344B2

(12) United States Patent
Lundsted Poulsen et al.

(10) Patent No.: US 11,280,344 B2
(45) Date of Patent: Mar. 22, 2022

(54) CENTRIFUGAL PUMP

(71) Applicant: GRUNDFOS HOLDING A/S, Bjerringbro (DK)

(72) Inventors: Brian Lundsted Poulsen, Langå (DK); Lasse Søgaard Ledet, Aalborg (DK)

(73) Assignee: Grundfos Holding A/S, Bjerringbro (DK)

( * ) Notice: Subject to any disclaimer, the term of this patent is extended or adjusted under 35 U.S.C. 154(b) by 7 days.

(21) Appl. No.: 16/470,876

(22) PCT Filed: Dec. 15, 2017

(86) PCT No.: PCT/EP2017/083121

§ 371 (c)(1),
(2) Date: Jun. 18, 2019

(87) PCT Pub. No.: WO2018/114709

PCT Pub. Date: Jun. 28, 2018

(65) Prior Publication Data

US 2019/0323513 A1 Oct. 24, 2019

(30) Foreign Application Priority Data

Dec. 20, 2016 (EP) ..... 16205241

(51) Int. Cl.
*F04D 29/16* (2006.01)
*F04D 17/08* (2006.01)

(52) U.S. Cl.
CPC ..... *F04D 29/161* (2013.01); *F04D 17/08* (2013.01); *F05B 2240/57* (2013.01)

(58) Field of Classification Search
CPC ..... F04D 29/161; F04D 29/16; F04D 29/162; F04D 17/08; F05B 2240/57
See application file for complete search history.

(56) References Cited

U.S. PATENT DOCUMENTS 2,644,403 A 7/1953 Dawson
3,020,850 A * 2/1962 Meckenstock ..... F04D 29/167 415/110
5,984,629 A * 11/1999 Brodersen ..... F04D 7/04 415/172.1

(Continued)

FOREIGN PATENT DOCUMENTS

CN 2486751 Y 4/2002
DE 10 2014 116 466 B3 12/2015
RU 2196254 C2 1/2003

*Primary Examiner* — Juan G Flores
*Assistant Examiner* — Joshua R Beebe
(74) *Attorney, Agent, or Firm* — McGlew and Tuttle, P.C.

(57) ABSTRACT

A centrifugal pump includes at least one pump stage, with a rotatable impeller (5) with a suction port (6) which is sealed with respect to a stationary pump part (1) by way of a sealing arrangement. The sealing arrangement includes a sealing ring (9) between the impeller (5) and the stationary pump part (1). The sealing arrangement is configured such that at least on delivery operation of the pump, the sealing arrangement has sealing sections which are distanced to the counter sealing surface and sealing sections which bear on the counter sealing surface, in an alternatingly successive manner considered in the peripheral direction of the sealing ring (9).

20 Claims, 9 Drawing Sheets

(56) References Cited

U.S. PATENT DOCUMENTS

| | | | | |
|---|---|---|---|---|
| 6,109,617 | A * | 8/2000 | Laney | F16J 15/3484 277/369 |
| 6,460,635 | B1 * | 10/2002 | Kalsi | E21B 10/22 175/229 |
| 2007/0160465 | A1 | 9/2007 | Roudnev | |
| 2007/0246894 | A1 * | 10/2007 | Foote | F16J 15/3244 277/500 |
| 2016/0169394 | A1 * | 6/2016 | Ranz | F04D 29/162 277/412 |

* cited by examiner

CENTRIFUGAL PUMP

CROSS REFERENCE TO RELATED APPLICATIONS

This application is a United States National Phase Application of International Application PCT/EP2017/083121 filed Dec. 15, 2017, and claims the benefit of priority under 35 U.S.C. § 119 of European Application 16205241.9, filed Dec. 20, 2016, the entire contents of which are incorporated herein by reference.

TECHNICAL FIELD

The invention relates to a centrifugal pump with at least one pump stage, with a rotatable impeller with a suction port which is sealed with respect to a stationary pump part by way of a sealing arrangement, wherein the sealing arrangement comprises a sealing ring between the impeller and the stationary pump part.

TECHNICAL BACKGROUND

Such sealing arrangements are counted as belonging to the state of the art. A centrifugal pump, with which a sealing ring on the housing side is arranged in the region of the suction port of the pump and comprises a sealing lip which bears on the outer side of the impeller, in the region of the suction port, is known from CN 2486751 Y. Thereby, the sealing lip is arranged such that the pressing pressure increases with an increasing impeller speed, thus with an increasing differential pressure between the delivery side and the suction side of the impeller. Although an almost complete sealing between the delivery side and the pressure side of the pump can be achieved by way of this, by which means leakage losses and thus efficiency losses due to leakage can be reduced, the friction between the sealing lip and the impeller however increases with the increasing pressure, which leads to friction losses reducing the efficiency as well as to a wearing on the sealing lip.

The sealing arrangement known from DE 10 2014 116 466 B3, with which a special sliding surface is provided on the outer periphery of the impeller, at the suction port side, and a sealing ring is incorporated at the casing side and with an edge of its free end bears on this sliding surface, is more favorable as far as this is concerned. Although the frictional losses and thus also the wear can be reduced by way of this arrangement, the sealing arrangement however is complicated with regards to its design and is prone to wear due to the fact that a section of the sealing ring constantly bears on the sliding surface of the impeller. The design moreover demands a high manufacturing and assembly precision, in order to arrange the components concentrically to one another.

The sealing of the suction port with respect to the stationary pump part by way of a sealing arrangement, although reducing the leakage losses, however increases the frictional losses within the pump, to the extent that the demands of a high sealing efficiency on the one hand and of low friction losses on the other hand are at odds with one another. Only the reduction of the gap between the suction port and the stationary pump part in a manner free of sealing means is more favorable inasmuch as this is concerned, but this however increases the manufacturing tolerance and therefore the manufacturing costs.

SUMMARY

Against this background, it is an object of the invention according to the application, to design a centrifugal pump of the known type, such that on the one hand an as good as possible sealing arises between the suction port and the stationary pump part during operation of the pump, and on the other hand as low as possible frictional losses arise.

The centrifugal pump according to the invention comprises at least one pump stage, with a rotatable impeller forming a suction port which is sealed with respect to a stationary pump part by way of a sealing arrangement, wherein the sealing arrangement comprises a sealing ring between the impeller and the stationary pump part. According to the invention, the sealing arrangement is configured such that at least on delivery operation of the pump, it has sealing sections which are distanced to the counter sealing surface and sealing sections which bear on the counter sealing surface, in an alternating successive manner considered in the peripheral direction of the sealing ring.

The basic concept of this solution according to the invention, is to let the sealing run in the manner of a plain bearing, so that a fluid film is built up between the sealing ring and the surface, on which this bears, at least on delivery operation of the pump, which is to say when the impeller rotates with respect to the stationary pump part, and hence viscous friction and not a full mechanical friction arises between the sealing ring and the counter sealing surface. Such a viscous friction minimizes the friction losses within the seal, but on the other hand permits the leakage losses within the sealing arrangement to be keep extremely low. Not only is the friction within the sealing arrangement significantly reduced due to the viscous friction, but the wearing of the seal itself is also reduced to a minimum.

Thereby, according to the invention, a complete viscous friction does not necessarily need to be ensured as is the case with a plain bearing. With the solution according to the invention, intermediate stages between viscous friction and a full mechanical friction can also be envisaged, which is to say that the surfaces of the sealing arrangement which are distanced to one another, although being envisaged for introducing fluid into the sealing gap between the sealing surface and the counter sealing surface in a manner reducing the friction, however a complete viscous friction does not necessarily need to occur, but, as the case may be also a mixed friction and, depending on the operating condition, also a full mechanical friction as the case may be. Thus for example a pointwise contact can be envisaged in the region between the sealing surfaces distanced to one another.

Thereby, according to the invention, one envisages the bearing which is to say contacting sealing sections being formed by the sealing ring itself. Inasmuch as it concerns the distanced sections lying between the contacting sealing sections, these can either be formed by the sealing ring itself or however also by the suction port of impeller or by the stationary part of the sealing arrangement, for example by way of recesses being provided there in the surface, or by way other comparable measures.

The solution according to the invention can be applied to single-stage as well as multi-stage centrifugal pumps, and with single-stage centrifugal pumps the sealing arrangement is typically effected between the suction port of the impeller and the casing, and with multi-stage arrangements between the suction port and a stationary pump part, typically a pump stage. Thereby, one or more stages can be provided with the sealing arrangement according to the invention. The impeller thereby is preferably a radial impeller or semi-axial impeller, which is to say an impeller, with which the suction port is directed in the axis direction of the impeller and the downstream side is directed radially or axially/radially. The invention however in principle is not limited to this construction type.

The basic concept of the present invention, specifically to have successive contacting and non-contacting sealing sections, in order to ensure the build-up of a fluid film between the seal and the counter sealing surface, according to the invention not only can be effected by way of a suitable design of the sealing surface and/or counter sealing surface, but alternatively or additionally also by the sealing ring, at least in sections, being configured elastically and the contact surface of the sealing ring or of the sealing ring sections on the counter surface is controlled by the hydraulic forces at the delivery side of the impeller.

The basic concept of this solution is to design the sealing ring with a different stiffness over its periphery and to arrange it such that the hydraulic forces due to the pressure difference between the delivery side and the suction side press the sealing ring towards the counter sealing surface to a different great extent over its periphery, on operation of the pump, thus on rotation of the impeller with respect to the stationary pump part. Thereby, according to the invention, one preferably envisages the sealing ring being configured and arranged such that it is arranged distanced to the counter sealing surface, in particular to the suction port, in the idle condition of the pump, thus when the impeller is at a standstill. Such an arrangement, with which the sealing ring does not bear on the counter sealing surface until there is a differential pressure between the suction side and the delivery side of the impeller, and on account of its structure is configured such that sections are present which bear on the counter sealing surface and alternatingly sections which do not bear on this or only with a reduced force, can likewise realize the principle according to the invention, with which the seal on operation is lubricated due to the fluid film, in the manner of a plain bearing. The latter arrangement moreover has the advantage that the sealing, i.e. the bearing of the sealing ring sections on the counter sealing surface is only effected during operation and otherwise a significant distance exists between the sealing ring and the counter sealing surface, by which means on the one hand a certain self-cleaning effect occurs, and on the other hand for example a scaling of the sealing surface is counteracted, due to these being in movement. Moreover, a significant advantage results due to the fact that the tolerances in the region of the sealing arrangement are such that the manufacture and assembly are simplified, and thus the manufacturing costs reduced.

The hydraulic control, to the extent that the sealing ring sections bear on the counter sealing surface, and others are distanced to this surface, and this being the case in an alternating manner, can advantageously be effected by way of the sealing ring having a stiffness which is different in a manner distributed over its periphery, preferably having alternating compliant and less compliant sections, namely sections of alternating stiffness, so that the sealing ring is deformed in a targeted manner given the application of hydraulic forces, in order to form contacting sections and non-contacting sections.

This principle can be achieved or additionally assisted by way of the sealing ring on its outer periphery having recesses which weaken the cross section and which preferably extend parallel to one another. These recesses, in which the material thickness is reduced, can be arranged parallel to the longitudinal middle axis of the sealing ring or also preferably obliquely to this, so that the alternating successive sections, at which the sealing surfaces bear on the counter sealing surface and at which they do not come to bear on this, are arranged in an overlapping manner seen in the axial direction.

Not only can the targeted material weakening be effected by recesses on the outer periphery of the sealing ring, but also and/or by recesses on the inner periphery. The arrangement of the sealing ring with respect to the suction port must be taken into account with the arrangement of the recesses. The sealing ring is typically configured such that it bears on the outer periphery of the suction port, and then the sealing ring can be freely configured at its outer periphery, whereas recesses on the inner periphery are to be dimensioned such that no unallowably high leakage losses occur. Thereby, in particular, the recesses on the inner periphery can be configured such that they run out towards the suction side, so that a narrow peripheral ring forms there, and this ring prevents leakage.

It is particularly when the sealing ring sealing bears with its outer periphery on the suction port, that it can be advantageous to provide the recesses on the inner periphery of the sealing ring, wherein these are usefully arranged parallel to one another, for example in a manner parallel to the axis or obliquely to this.

According to an advantageous further development of the invention, the recesses are configured in a wedge-like manner seen in the peripheral direction. Such a design, in particular at the side of the sealing ring which is envisaged for contact on the counter sealing surface, has the advantage that a fluid film is reliably built up due to the wedge-like recesses which lie in the rotation direction and which are filled with delivery fluid on operation, and this film ensures a low-friction sliding of the sealing ring on the counter sealing surface.

The wedge-like recesses effect target material weakenings, at the side of the sealing ring which is away from the counter sealing surface, wherein the material weakening is not abrupt in both peripheral directions, but only in one direction, and in the other direction is effected in an increasing manner, on account of the wedge shape, by which means it is ensured that the sealing ring only deforms at the desired locations and in the desired manner, when subjected to pressure.

In practice, it has been found to be particularly advantageous, to provide such wedge-like recesses at both sides of the sealing ring. If, as is advantageous, the recesses are configured in a wedge-like manner in the peripheral direction, then it is advantageous to arrange the wedge-like recesses on the outer periphery in a manner directed oppositely to the wedge-like recesses on the inner periphery. It is particularly preferable to then yet arrange these offset to one another. The sealing ring can be configured in a precise manner, as is particularly advantageous for a certain case of application, by way of varying the angle of offset, the depth and the gradient of the recesses. It is to be understood that the sealing arrangement according to the invention, although being effective and efficient for a large speed range, however the effectiveness is at its greatest in a certain speed range. This range is usefully configured such that it is the speed range, in which the centrifugal pump is presumably operated most often. However, according to the invention, one can also envisage the design of the sealing arrangement being such that it is at its most effective in the highest pressure range of the pump. This makes sense inasmuch as the leakage losses are typically at their greatest in the highest pressure region, with centrifugal pumps according to the state of the art.

It is particularly preferable if the sealing ring is attached to the stationary pump part and is provided for sealing with respect to an outer surface of the impeller, close to the suction port. The suction region of the pump is hereby not affected by way of this, and a type of Venturi effect also sets in, at least when the sealing ring is arranged at a distance to the impeller, when this impeller starts up, by which means the pressure onto the outer side increases, and the procedure of the sealing ring bearing on the counter sealing surface on the outer periphery of the impeller in a sectioned manner is accelerated. The arrangement is thereby such that the outer periphery of the sealing ring is subjected to the pressure of the delivery side of the impeller during operation, by way of which pressure the bearing of the sealing ring upon the impeller is finally controlled, in the same manner as the deformation of the sealing ring. There is a large variance concerning the arrangement of the sealing ring, as is specified in detail further below, wherein common to all arrangements is the is the fact that an outer surface of the sealing ring is subjected to the pressure at the delivery side of the impeller, whereas another side is envisaged for bearing on a counter sliding surface which is at the impeller side.

It is to be noted that it is basically of no significance for the functioning of the sealing arrangement, as has been initially described, as to whether the sealing ring is arranged at the housing side or at the impeller side, but as a rule it will be the housing arrangement, which is to say the arrangement of a stationary pump part, which will be the more favourable option, since any imbalances of the sealing ring are then of no significance and the moment of inertia of the impeller is not increased by the sealing ring.

Thus with an arrangement of the sealing ring on the impeller, this is preferably arranged at the suction-side end of the impeller, and a counter sealing surface is formed by a ring section of the stationary pump part which immerses into the sealing ring—if the sealing is effected radially—or by way of an axial, annular surface of the stationary pump part—if the sealing is effected axially. In the case of an axial sealing, the annular surface lies in a plane transverse to the rotation axis of the impeller, whereas with a radial sealing, the ring section is formed by a cylinder surface arranged parallel to the rotation axis.

With such an arrangement, it is advantageous if the sealing ring is arranged in a manner continuing the suction port of the impeller, which is to say if the sealing ring quasi forms the suction port which however with regard to the function is displaced into the inside of the impeller due to the immersing stationary pump part. With regard to the sealing ring, it is essential that in particular the outer side where possible is completely subjected to the pressure of the delivery side of the impeller, if the initially described deformation is to be effected on account of hydraulic forces of the delivery fluid.

The core concept of the solution according to the invention is to design the sealing ring such that on operation, a hydrodynamic or hydrostatic fluid film forms between the surfaces of the sealing arrangement which are moved to one another. This can be effected hydrodynamically by way of a suitable shaping of the sealing ring and/or its recesses, for example in a wedge-like manner, and hydrostatically for example by channels which are provided in the sealing ring, lead to the delivery side and run out into the sealing surface. A combination of a hydrodynamically and hydrostatically built-up fluid film can also be provided.

The invention is hereinafter explained in more detail by way of embodiment examples represented in the drawing. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
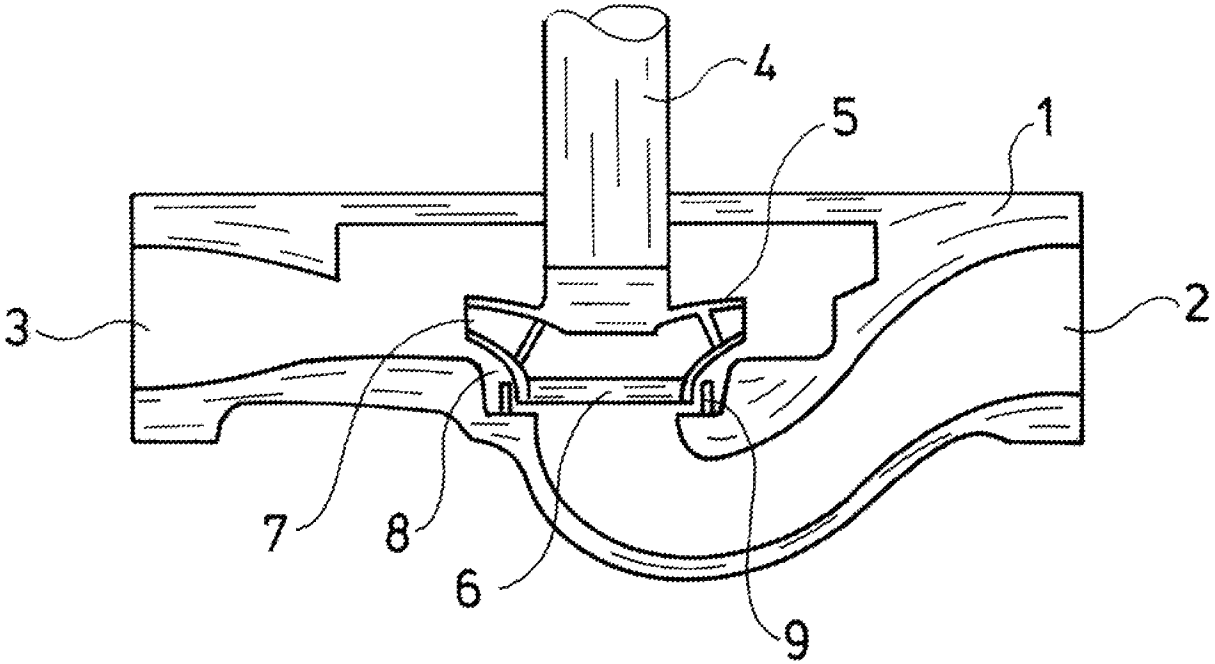
FIG. 1 is a greatly simplified and showing a centrifugal pump with a sealing arrangement according to the invention.

Referring to the drawings, the centrifugal pump which is represented in a greatly simplified manner in FIG. 1, comprises a stationary pump casing 1 which comprises a suction connection 2 as well as a delivery connection 3, in which a shaft 4 is rotatably mounted, said shaft driving an impeller 5 which is seated therein and whose axial suction port 6 is conductively connected to the suction connection 2 and whose downstream side 7 is arranged in a radial manner and conductively connected to the delivery connection 3.

The pump casing 1 here represents any stationary pump component, for example with a multi-stage pump represents the stationary part of a pump stage, which is to say that the principle representation represented by way of FIG. 1 can be applied to one or several arbitrary impellers with the respective stationary pump parts.

A leakage channel 8 which can be shut off by a sealing ring 9 in the pump, is formed between the downstream side 7 thus the delivery side of the pump, and the suction port 6, thus the suction side of the pump. Examples concerning the design of the sealing arrangement between the suction port 6 of the centrifugal pump, thus the suction side and the leakage channel 8 connected to the delivery side are represented in detail in FIGS. 2 to 7, but these only schematically show a part of this leakage channel 8, of the impeller 5, of the pump casing 1 as well as of the sealing ring 9.

Figure 2:
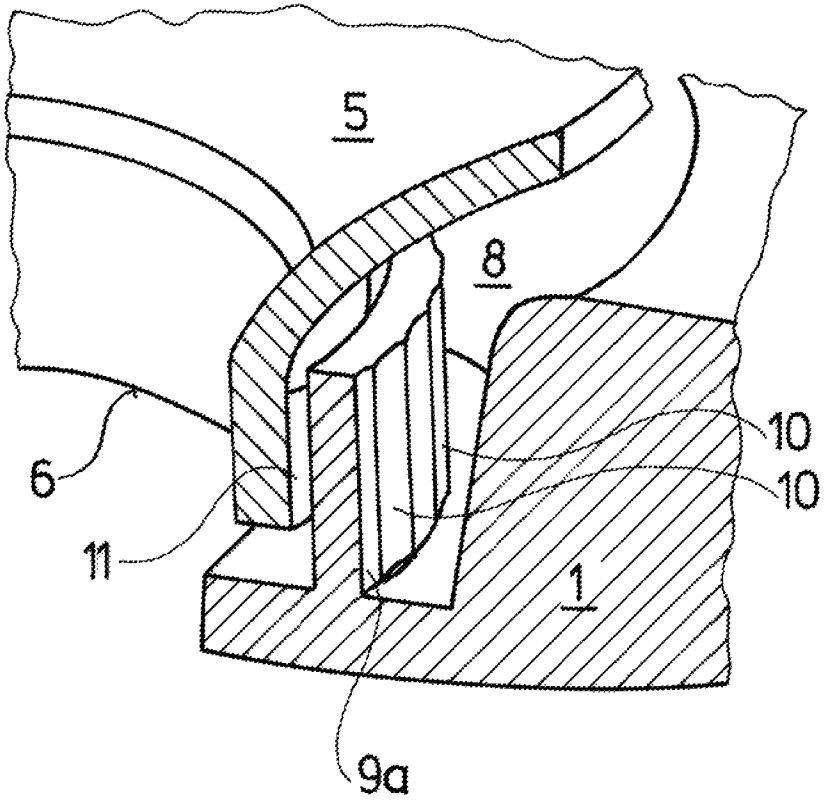
FIG. 2 is a perspective sectional view of a first embodiment variant of the sealing arrangement with a stationary sealing ring.

The sealing ring 9*a* which is represented by way of FIG. 2 and which is arranged in the same manner as the sealing ring 9 represented by way of FIG. 1 is fastened with its narrow face side, in FIG. 2 its lower side, to the stationary part 1 of the pump. It has a slim ring-cylindrical shape, wherein the inner side of the sealing ring 9*a* is envisaged to come to bear on the outer periphery which is essentially cylindrical there, in the region of the suction port 6 of the impeller 5. In the non-loaded condition, the sealing ring 9*a* is arranged at a small distance to the outer side of the suction port 6 of the impeller 5. The sealing ring 9*a* comprises recesses 10 distributed over its outer periphery, which here are provided parallel to one another and parallel to the longitudinal axis of the sealing ring 9*a*, at regular angular intervals on the outer periphery. The stiffness of the sealing ring 9*a* is weakened by these recesses 10 having a part-circular cross section, to such an extent that the sealing ring 9*a* has the smallest material thickness at the base of a recess 10 and the largest material thickness at the edge of the recess 10. The sealing ring 9*a* is constructed of elastic material and with regard to the material and size is adapted such that the gap which is formed between the inner side of the sealing ring 9*a* and the outer side of the suction port 6 of the impeller 5 is closed on operation of the pump. This means that when the impeller 5 is driven by the shaft 4, and a pressure difference between the suction port 6 and the downstream side 7 is produced by way of this, the hydraulic and flow forces which then set in control the sealing ring 9*a* to bear upon the impeller 5, in the outer region of the suction port 6. Thereby, a Venturi effect firstly arises in the region of the sealing ring 9*a* at the outer side due to the swirling of the fluid exiting from the impeller 5 at the downstream side 7, and this Venturi effect then, in combination with building-up differential pressure between the downstream side 7 and the suction port 6 leads to the sealing ring 9*a* being pressed from the outside to the inside. However, the contact of the sealing ring 9*a* on the outer side of the suction port 6 is not effected over the whole periphery, but only in sections on account of the different stiffness of the sealing ring 9*a* in the peripheral direction, caused by the different material thickness. The inner side of the sealing ring 9*a* thus does not peripherally bear on the counter sealing surface 11 over the whole surface, but a contacting sealing ring section, in the peripheral direction is followed by one which is distanced and then by a contacting one, etc., in an alternating manner, over the whole periphery of the ring 9*a*. Delivery fluid gets into the region between the sealing ring 9*a* and the counter sealing surface 11 via the leakage channel 8, in the non-contacting sections of the sealing ring 9*a*, and this fluid is distributed over the sealing surface on account of the alternating contacting and non-contacting sections and the rotation of the impeller, so that a viscous friction always prevails in the region between the sealing ring 9*a* and the counter sealing surface 11.

Figure 3:
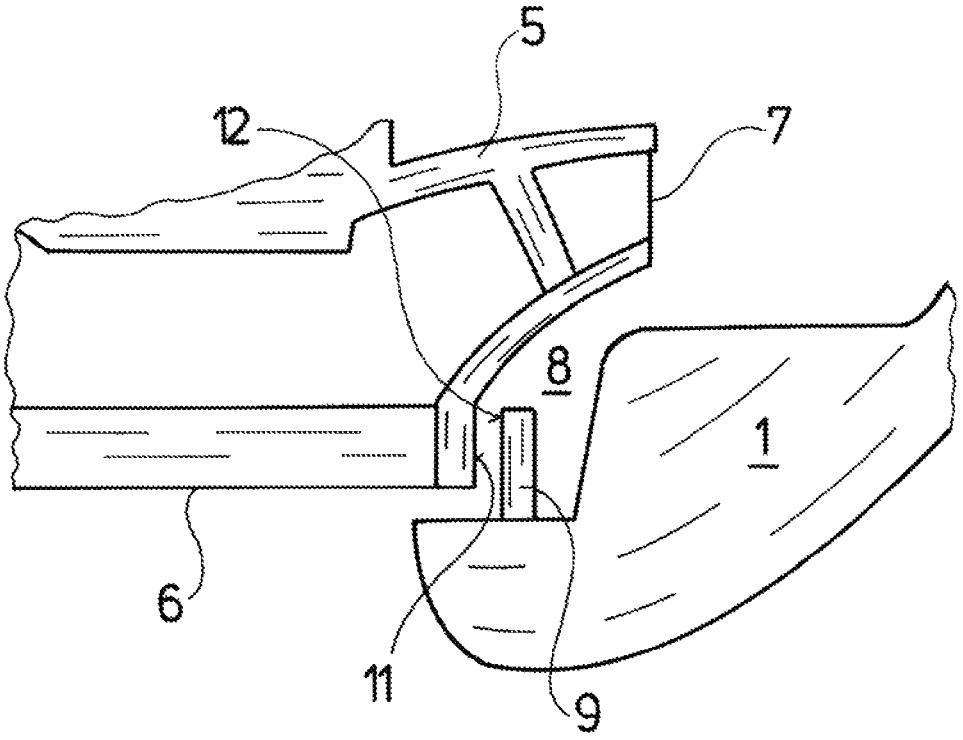
FIG. 3 is a schematic longitudinally sectional representation showing a sealing arrangement in a standstill state of the impeller.
Figure 4:
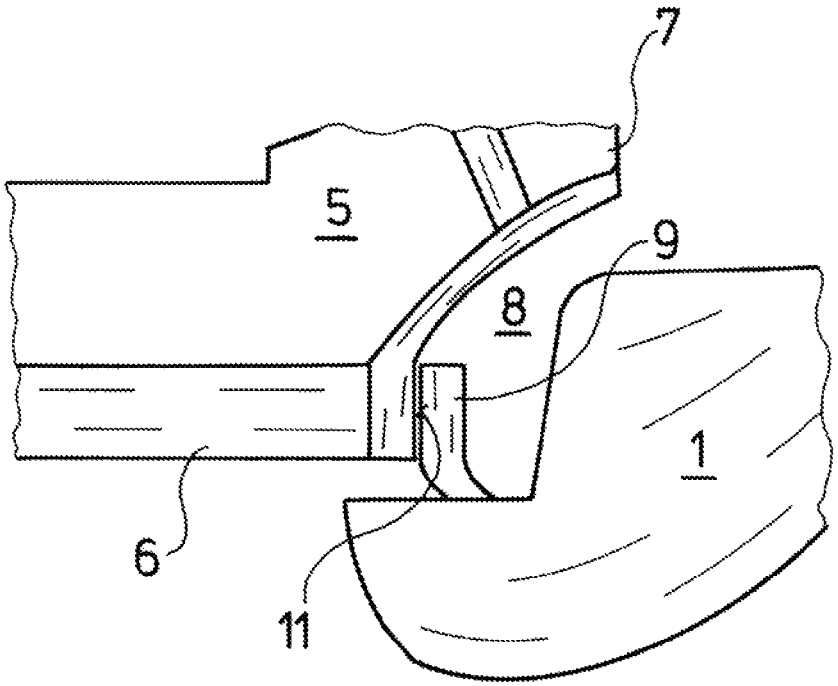
FIG. 4 is a schematic longitudinally sectional representation showing a sealing arrangement according to claim 3 in an operation state of the pump.

As to how the sealing ring 9 which is fastened on the casing side, comes to bear from its static position (FIG. 3), in which the impeller 5 is at a standstill, onto the counter sealing surface 11 of the impeller 5, on rotation of the impeller 5 firstly due to the Venturi effect building up at the outer side and then due to the differential pressure between the delivery side and the suction side, is schematically represented by way of FIGS. 3 and 4.

Figure 8:
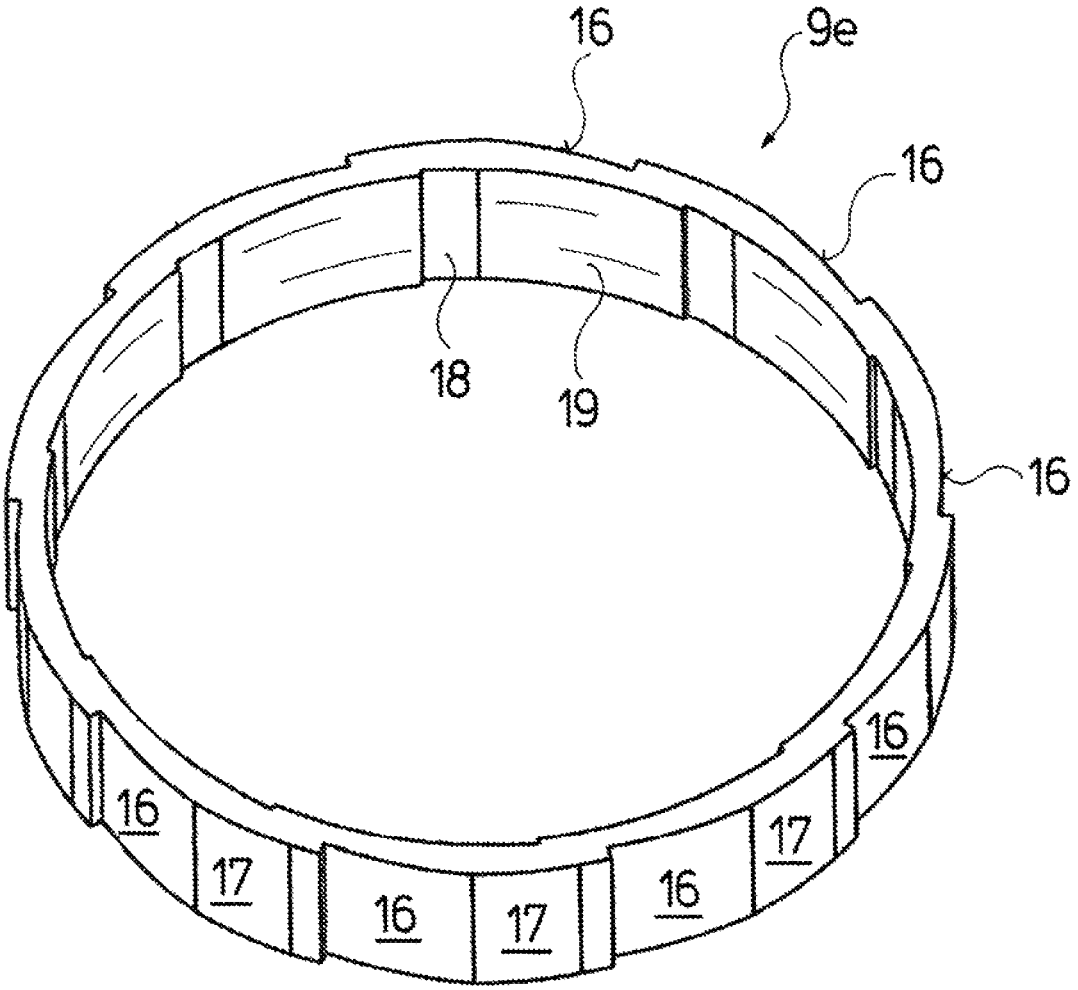
FIG. 8 is a perspective representation of a sealing ring according to the invention.
Figure 9:
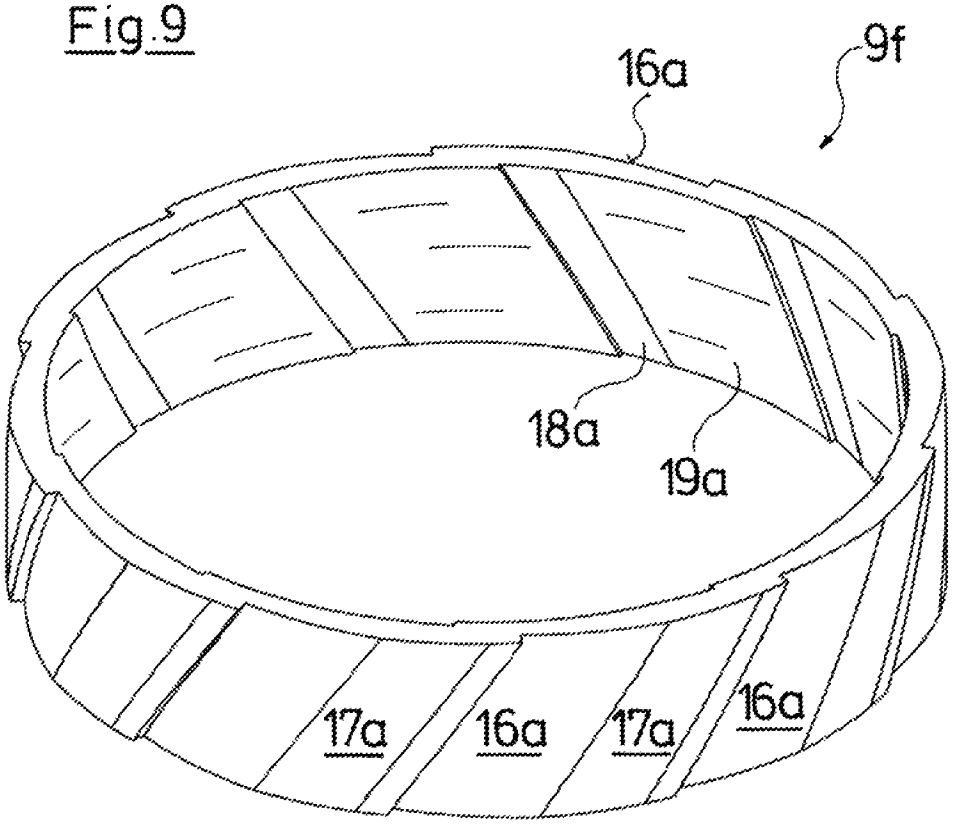
FIG. 9 is a perspective representation of an alternative embodiment of the sealing ring.

The structure with recesses 10 on the outer periphery of the sealing ring 9*a* and which is described by way of the impeller 9*a* in FIG. 2 can be applied, in order to create alternatingly contacting and non-contacting sections between the sealing surface 12 and the counter sealing surface 11, in order to built up a load-bearing fluid film between the sealing surface 12 of the sealing ring 9 and the counter sealing surface 11 on the impeller 5. Additionally or in an assisting manner, recesses which assist or create this effect can be present in the sealing surface 12 or in the counter sealing surface 11, in the surface. The sealing rings which are yet to be described in more detail further below by way of FIGS. 8 and 9 illustrate as to how such a design could look.

The bearing (contacting) of the sealing ring 9 onto the suction port 6, as is represented in FIG. 4, is effected exclusively by hydraulic forces, so that the sealing ring 9 returns into its initial position which is represented in FIG. 3 and in which a gap between the sealing surface 12 and the counter sealing surface 11 is formed in the leakage channel 8, given a standstill of the impeller 5. This elastic movement of the sealing ring 9, with the bearing contact and the return movement cleans the sealing gap and ensures that no deposits can form, in particular on the sealing surface 12.

Figure 5:
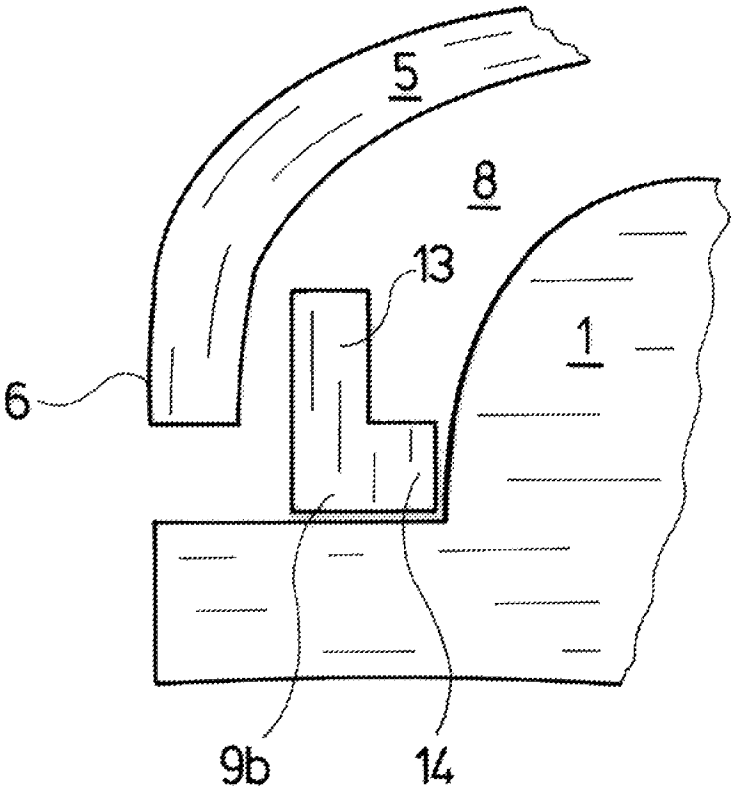
FIG. 5 is a schematic longitudinally sectional representation showing a further sealing arrangement in a standstill state of the impeller.

A sealing ring 9*b* which comprises a profile which is L-shaped in cross section is represented by way of FIG. 5, wherein an upright limb 13 corresponds to the sealing ring 9 described by way of FIGS. 3 and 4, whereas a lying limb 14 is provided for fastening the sealing ring 9*b* to the stationary part 1 of the pump, thus for example on the pump casing 1. The fastening of the sealing ring 9*b* can be effected materially and/or non-positively, by way of the ring 9*b* being pressed into the corresponding recess of the pump casing 1.

Figure 6:
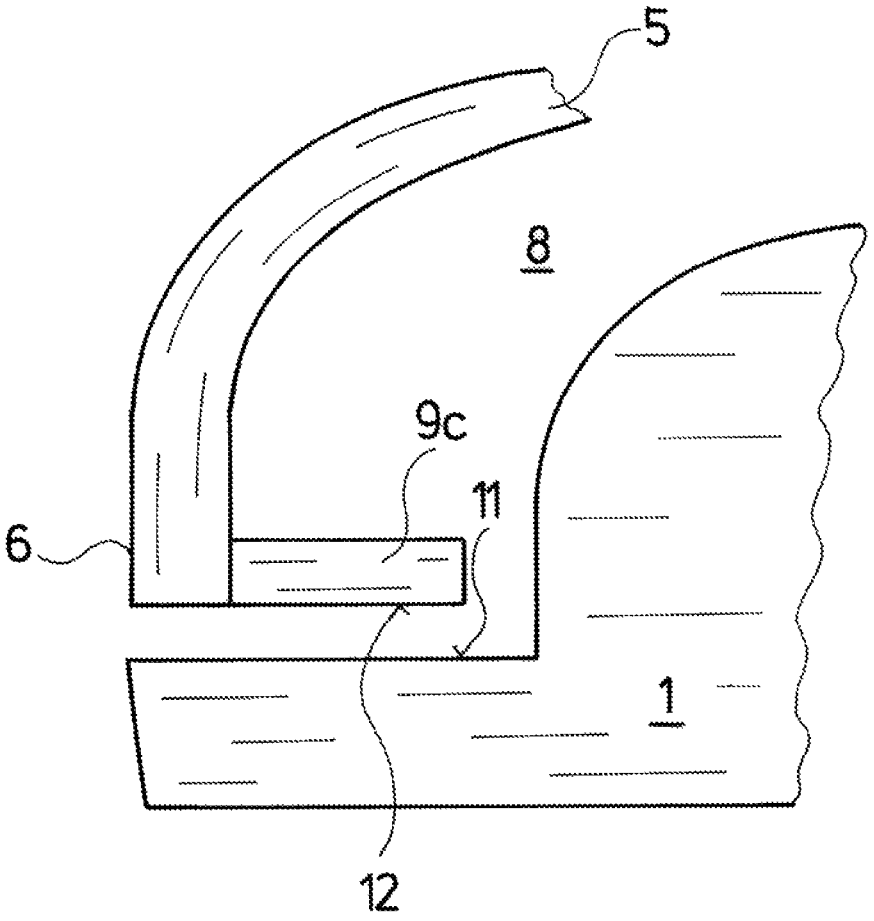
FIG. 6 is a schematic longitudinally sectional representation showing a first embodiment of a sealing arrangement with a rotating sealing ring in a standstill state of the impeller.

With the embodiment variant represented by way of FIG. 6, a sealing ring 9*c* is provided and this has the shape of a ring disc and at its inner periphery is fixedly connected to the outer periphery of the impeller 5, in the region of the suction port 6. The sealing ring 9*c* hence co-rotates with the impeller 5, and its sealing surface 12 comes to bear on the counter sealing surface 11 on the pump casing, wherein here too, the differential pressure between the delivery side of the impeller and the suction side ensures a sectioned contacting of the sealing surface 12 on the counter sealing surface 11. With this embodiment too, the sealing ring 9*c* is of a differing stiffness due to recesses on its outer periphery, which are not represented, so that sections of the sealing surface 12 bearing on the counter sealing surface 11 form, and sections which are distanced to this, so that the previously described "plain bearing effect" also occurs with this arrangement, which is to say a load-bearing fluid film is formed between the sealing surface 12 and the counter sealing surface 11.

Figure 7:
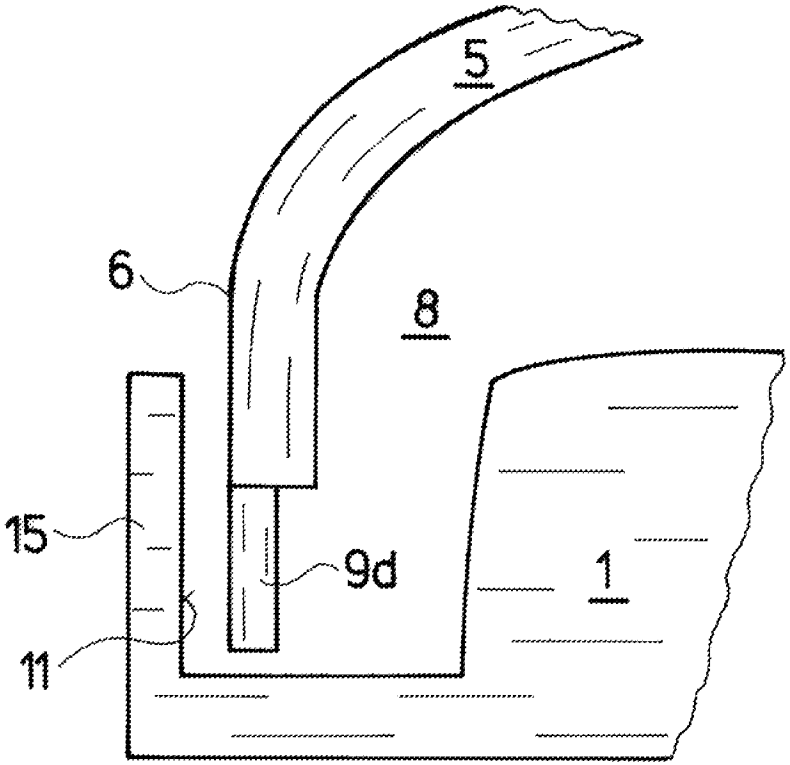
FIG. 7 is a schematic longitudinally sectional representation showing an alternative arrangement with a rotating sealing ring in a standstill state of the impeller.

With the embodiment variant which is represented by way of FIG. 7, the sealing ring 9*d* is arranged on the suction-side face side of the impeller 5 in the extension of the suction port 6. On the casing side, a ring section 15 which is arranged within the sealing ring 9*d* and which reaches up to the suction port 6 of the impeller 5 is provided. The counter sealing surface 11 for the sealing ring 9*d* is formed by the inner side of this ring section 15. The sealing ring 9*d* can be configured in the same manner as the sealing ring 9*a* described by way of FIG. 2, or as the sealing rings which are yet described further below by way of FIGS. 8 and 9.

A sealing ring 9*e* is provided with the embodiment variant according to FIG. 8. FIG. 8 by way of example shows how such a sealing ring 9 of FIG. 3 or 4, which consists of elastic material, for example rubber, silicone or likewise, can be configured, so as to achieve the previously described effects. The sealing ring 9*e* in total comprises ten wedge-like recesses 16 which are distributed over its outer periphery, and the depth of these recesses increases in the clockwise direction, which is to say penetrate more deeply into the base material, in the representation according to FIG. 8. These wedge-like recesses 16 alternate with sections 17 which form part of a cylinder surface. The sealing ring 9*e* also comprises wedge-like recesses 18 at the inner side, which is to say on its inner periphery, and these recesses are interrupted by cylindrical sections 19 which likewise lie on a common cylinder surface. The recesses 18 at the inner side extend roughly over only a third of the periphery of the recesses 16 on the outer side and over a shallower depth. Thereby, the direction of the wedge shape of the recesses 18 is opposite to the direction of that of the recesses 16.

Whereas the recesses 16 serve exclusively for the targeted weakening of the ring material, so that this at its inner side deforms in a humped fashion in a targeted manner given a build-up of a pressure from the outside, which is to say forms sections which bear on the counter sealing surface 11, and ones which are distanced to this, the recesses 18 on the inner periphery first and foremost serve for forming a load-bearing (load-supporting) lubricant film between the sealing surface 12, thus the inner side of the sealing ring 9*e*, and the counter sealing surface 11. These however can also have an influence upon the deformation of the sealing ring.

An alternative embodiment of such a sealing ring 9*f* is represented by way of FIG. 9. The construction of the sealing ring 9*f* of an elastic material, with which wedge-like recesses 16*a* at the outer side alternate with cylindrical sections 17*a* and with which wedge-like recesses 18*a* at the inner side alternate with cylindrical sections 19*a*, differs from the previously described embodiment represented by way of FIG. 8, essentially in that the recesses 16*a* and 18*a* as well as the sections 17*a* and 19*a* are not arranged parallel to the axis of the ring 9*f*, but obliquely to it, and specifically on the outer side and on the inner side with the same obliqueness, so that contacting and non-contacting sections of the sealing ring 9*f* result given a subjection of pressure from the outside, and these sections overlap seen in the axis direction. A certain pumping effect is achieved due to the inclination of the wedge-like recesses 18*a* on the inner side, and this pump effect ensures that a load-supporting fluid film arises in the sealing gap between the sealing surface 12 and the counter sealing surface 11, even with high pressing forces. Moreover, the leakage losses are further reduced by such an oblique design.

The embodiment examples specified above cannot even begin to represent the numerous possibilities of sealing ring designs which result from disclosure of the present invention. In the individual case, one is to determine experimentally and/or by computation, as to how a load-bearing fluid film sets in between the sealing ring and the counter sealing surface, and specifically over an as large as possible speed range of the pump, in or to keep wear and friction losses at the seal as low as possible.

While specific embodiments of the invention have been shown and described in detail to illustrate the application of the principles of the invention, it will be understood that the invention may be embodied otherwise without departing from such principles.

The invention claimed is:

1. A centrifugal pump with at least one pump stage comprising:

a rotatable impeller;

a stationary pump part;

a suction port;

a sealing arrangement, the suction port being sealed with respect to the stationary pump part by way of the sealing arrangement, wherein the sealing arrangement comprises a sealing ring between the impeller and the stationary pump part, wherein the sealing ring comprises sealing sections interacting with a counter sealing surface and the sealing arrangement is configured such that at least on delivery operation of the pump, the sealing sections are distanced to the counter sealing surface and the sealing sections bear on the counter sealing surface, in an alternatingly successive manner considered in a peripheral direction of the sealing ring, wherein the sealing ring at least in sections is elastically configured and a contact surface of the sealing ring or of sealing ring sections on the counter surface is controlled by hydraulic forces at a delivery side of the impeller, the sealing ring having sections of different stiffness, which are distributed over a sealing ring periphery, wherein the sealing ring on a sealing ring outer periphery comprises recesses which reduce a sealing ring cross section, the sealing sections of the sealing ring being located at a spaced location from the counter sealing surface when the impeller is at a standstill.

2. A centrifugal pump according to claim 1, wherein the sealing ring on a sealing ring inner periphery comprises recesses which reduce the sealing ring cross section.

3. A centrifugal pump according to claim 2, wherein the recesses extend parallel to an axis direction of the sealing ring or obliquely thereto.

4. A centrifugal pump according to claim 2, wherein the recesses have a wedge configuration in the peripheral direction.

5. A centrifugal pump according to claim 2, wherein the recesses are open towards the delivery side of the impeller as well as towards a suction side of the impeller.

6. A centrifugal pump according to claim 5, wherein:

the recesses have a wedge configuration in the peripheral direction; and the wedge configuration of the recesses on the outer periphery and the wedge configuration of the recesses on the inner periphery are directed oppositely to one another.

7. A centrifugal pump according to claim 1, wherein the sealing ring is arranged on the stationary pump part, and is arranged adjacent to the suction port, for sealing with respect to an outer surface of the impeller.

8. A centrifugal pump according to claim 1, wherein the sealing ring is arranged on the impeller, at the suction-side end of the impeller, and the counter sealing surface is formed by a ring section of the stationary pump part which overlaps the sealing ring.

9. A centrifugal pump according to claim 1, wherein the sealing ring is arranged on the impeller, at the suction-side end of the impeller, and the counter sealing surface is formed by an annular surface of the stationary pump part.

10. A centrifugal pump according to claim 1, wherein the sealing ring defines an extent of the suction port of the impeller.

11. A centrifugal pump according to claim 1, wherein the sealing ring is configured such that on operation, a hydrodynamic or hydrostatic fluid film forms between the surfaces of the sealing arrangement which are moved relative to one another.

12. A centrifugal pump according to claim 1, wherein the recesses extend parallel to an axis direction of the sealing ring or obliquely thereto.

13. A centrifugal pump according to claim 1, wherein the recesses have a wedge configuration in the peripheral direction.

14. A centrifugal pump according to claim 13, wherein the recesses are open towards the delivery side of the impeller as well as towards the suction side of the impeller.

15. A centrifugal pump according to claim 14, wherein:

the sealing ring on a sealing ring inner periphery comprises recesses which reduce the sealing ring cross section, the recesses having a wedge configuration in the peripheral direction; and the wedge configuration of the recesses on the outer periphery and the wedge configuration of the recesses on the inner periphery are directed oppositely to one another.

16. A centrifugal pump according to claim 1, wherein each recess is defined by at least an edge portion of the sealing ring and a base portion of the sealing ring, the sealing ring having a first thickness at the base portion and the sealing ring having a second thickness at the base portion, the first thickness being less than the second thickness.

17. A centrifugal pump with at least one pump stage comprising:

a rotatable impeller;

a stationary pump part;

a suction port;

a sealing arrangement, the suction port being sealed with respect to the stationary pump part via the sealing arrangement, the sealing arrangement comprising a sealing ring between the impeller and the stationary pump part, the sealing ring comprising sealing sections interacting with a counter sealing surface and the sealing arrangement being configured such that at least on delivery operation of the pump, the sealing sections are distanced to the counter sealing surface and the sealing sections bear on the counter sealing surface, in an alternatingly successive manner considered in a peripheral direction of the sealing ring, the sealing ring at least in sections being elastically configured and a contact surface of the sealing ring or of sealing ring sections on the counter surface being controlled by hydraulic forces at a delivery side of the impeller, the sealing ring having sections of different stiffness, which are distributed over a sealing ring periphery, the sealing ring comprising a sealing ring outer peripheral surface facing in a direction away from the counter sealing surface, the sealing ring outer peripheral surface defining recesses which reduce a cross section of the sealing ring, each of the sealing sections of the sealing ring being located at a spaced location from the counter sealing surface when the impeller is at a standstill.

18. A centrifugal pump according to claim 17, wherein the sealing ring outer peripheral surface is located a spaced location from the counter sealing surface.

19. A centrifugal pump according to claim 18, wherein the sealing ring outer peripheral surface comprises a plurality of base portions and a plurality of edge portions, each of the recesses being defined by at least one of the edge portions and one of the base portions, the sealing ring having a first thickness at each of the base portions and the sealing ring having a second thickness at each of the edge portions, the second thickness being greater than the first thickness.

20. A centrifugal pump according to claim 18, wherein the sealing ring comprises a sealing ring inner peripheral surface facing in a direction of the counter sealing surface, the sealing ring inner peripheral surface comprising inner recesses which reduce the sealing ring cross section.

* * * * *